US009139965B1

(12) United States Patent
Frelich et al.

(10) Patent No.: US 9,139,965 B1
(45) Date of Patent: Sep. 22, 2015

(54) COMPACTION ON-SITE CALIBRATION

(71) Applicant: Caterpillar Paving Products Inc., Brooklyn Park, MN (US)

(72) Inventors: Thomas J. Frelich, Albertville, MN (US); Kyle David Hendricks, St. Francis, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 14/462,237

(22) Filed: Aug. 18, 2014

(51) Int. Cl.
*E01C 19/26* (2006.01)
*E02D 3/026* (2006.01)

(52) U.S. Cl.
CPC ..... *E01C 19/26* (2013.01); *E02D 3/026* (2013.01)

(58) Field of Classification Search
USPC ..... 701/50
See application file for complete search history.

(56) References Cited

U.S. PATENT DOCUMENTS

| | | | | |
|---|---|---|---|---|
| 5,177,415 | A | 1/1993 | Quibel et al. | |
| 5,727,900 | A * | 3/1998 | Sandstrom | 404/84.1 |
| 6,122,601 | A * | 9/2000 | Swanson et al. | 702/137 |
| 7,623,951 | B2 * | 11/2009 | Congdon et al. | 701/50 |
| 7,908,084 | B2 * | 3/2011 | Anderegg et al. | 702/1 |
| 8,057,124 | B2 | 11/2011 | Stenzel et al. | |
| 8,190,338 | B2 * | 5/2012 | Commuri | 701/50 |
| 8,602,680 | B2 | 12/2013 | Fischer et al. | |
| 2007/0150147 | A1 * | 6/2007 | Rasmussen et al. | 701/50 |
| 2009/0214300 | A1 | 8/2009 | Birgisson et al. | |
| 2010/0166499 | A1 | 7/2010 | Stenzel | |

* cited by examiner

*Primary Examiner* — Thomas Tarcza
*Assistant Examiner* — Alex C Dunn
(74) *Attorney, Agent, or Firm* — Miller, Matthias & Hull LLP

(57) ABSTRACT

A system and method for calibrating a compactor. The compactor may have a roller. The system may comprise a display and a controller. The controller may be configured to receive, when the roller rotates in a first direction, a first baseline compaction value, receive, when the roller rotates in a second direction, a second baseline compaction value, calculate an offset between the first and second baseline compaction values, receive a subsequent compaction value obtained while the roller is rotating in the second direction, adjust the subsequent compaction value by the offset difference, and display an adjusted subsequent compaction value on the display.

20 Claims, 4 Drawing Sheets

COMPACTION ON-SITE CALIBRATION

TECHNICAL FIELD

The present disclosure generally relates to systems for use on compactors to calibrate compaction measurement.

BACKGROUND

Compacting machines or compactors are commonly used to compact work materials (such as soil, gravel, asphalt, landfill trash) to a desired density while constructing buildings, roads, parking lots, and other structures. In addition, compactors are often used to compact recently moved and/or relatively soft materials at mining sites and landfills. The process often requires a plurality of passes over the work material to reach the desired density.

Various types of compactors are known in the art. Some compactors include a rotatable roller drum that may be rolled over the surface to compress the material underneath. In addition to utilizing the weight of the roller to provide the compressive forces that compact the material, some compactors are configured to also induce a vibratory force to the surface. The vibratory forces assist in compacting the surface into a dense mass. To generate the vibratory forces one or more weights or masses may be disposed inside the roller at a position that is off center from the axis line around which the roller rotates. As the roller rotates, the position of the masses induce oscillatory or vibrational forces to the roller that are imparted to the surface being compacted.

Determining whether the desired level of compaction has been reached for the surface material being compacted may be estimated in a variety of manners. In some instances, the compaction may be approximated by compaction measurement system that measures the amount of power required to move the compactor along the surface of a work site. The compaction measurement system may determine a state of compaction relative to an absolute scale or a maximum amount of compaction. Data for compaction measurements may be obtained when the compactor moves in forward drive over a surface area and when the compactor moves in reverse drive over the same surface area. Sometimes the compaction measurements obtained on-site in forward drive and obtained in reverse drive are not the same for material with the same stiffness. It has been theorized that this may be due to a variety of causes, including machine calibration, roller bow wave, moisture content of surface material, and/or roller following versus roller leading through surface material.

U.S. Publication No. 2009/0108300 published Aug. 27, 2009 discloses an apparatus for controlling the compactive effort delivered to a soil by a compaction unit based on measured soil compaction. While this system may be beneficial, it does not address the sensitivity of soil compaction measurements to the direction of movement of the compactor. A better system is needed to calibrate the displayed compaction measurement for work site conditions.

SUMMARY OF THE DISCLOSURE

In accordance with one aspect of the disclosure, a system on a compactor is disclosed. The compactor may include a roller. The system may comprise a display and a controller. The controller may be configured to receive, when the roller rotates in a first direction, a first baseline compaction value, receive, when the roller rotates in a second direction, a second baseline compaction value, calculate an offset between the first and second baseline compaction values, receive a subsequent compaction value obtained while the roller is rotating in the second direction, adjust the subsequent compaction value by the offset, and display an adjusted subsequent compaction value on the display.

In accordance with another aspect of the disclosure, a method of calibrating a compactor having a roller is disclosed. The compactor may be disposed at a work site. The method may comprise receiving, when the roller rotates in a first direction, a first baseline compaction value, receiving, when the roller rotates in a second direction, a second baseline compaction value, calculating an offset between the first and second baseline compaction values, adjusting, by a controller operably connected to the compactor, subsequent compaction values by the offset when the subsequent compaction values are obtained during rotation of the roller in the second direction, and displaying adjusted subsequent compaction values resulting from the adjusting.

In accordance with a further aspect of the disclosure a system on a compactor is disclosed. The compactor may have forward drive and reverse drive, and may include a roller. The system may comprise a display, a calibration interface operably connected to a controller and configured to receive activation input, and the controller. The controller may be configured to receive data representative of a first baseline compaction value obtained when the compactor is in forward drive, receive data representative of a second baseline compaction value obtained when the compactor is in reverse drive, calculate an offset between the first and second baseline compaction values, adjust subsequent compaction values by the offset when the subsequent compaction values are obtained during reverse drive of the compactor, and display on the display adjusted subsequent compaction values.

DETAILED DESCRIPTION

Figure 1:
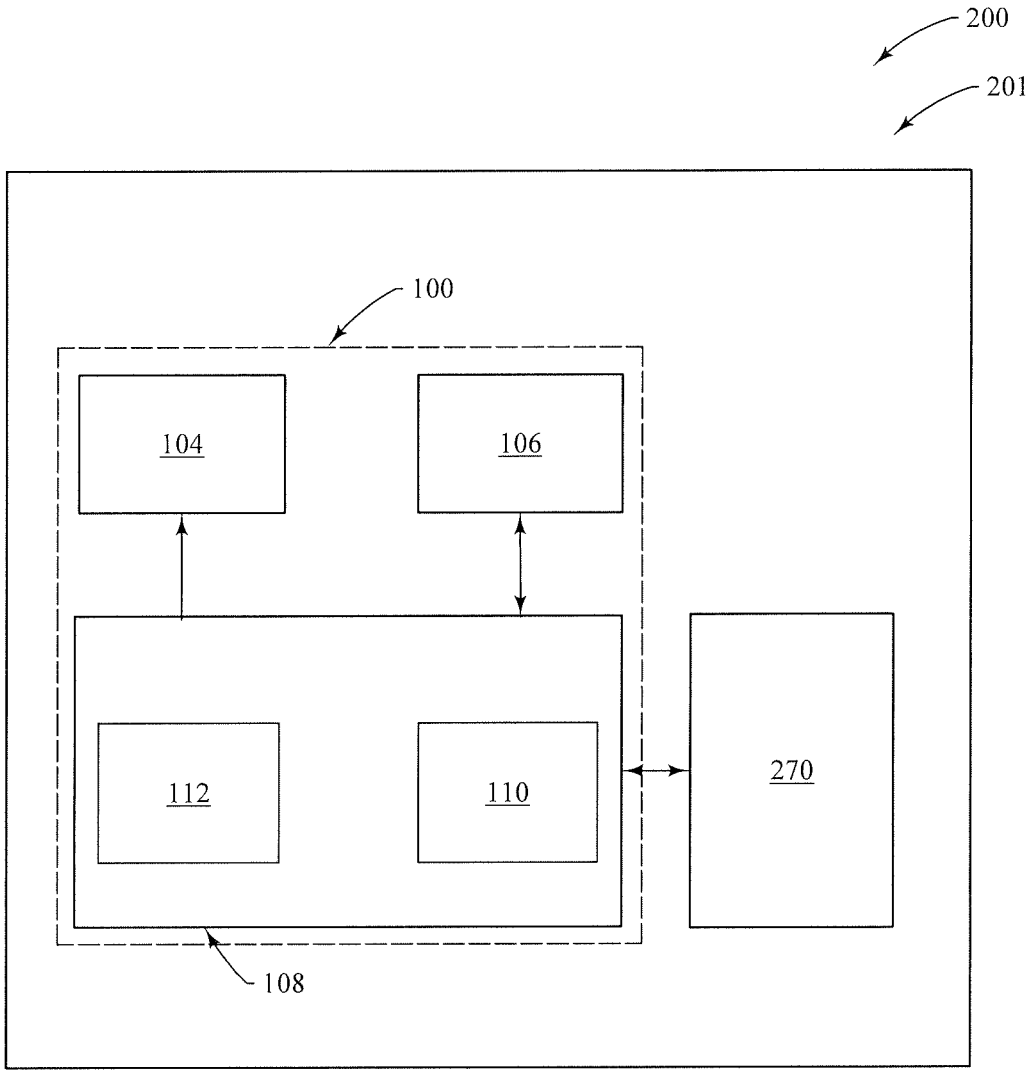
FIG. 1 is a schematic of an exemplary embodiment of a system in accordance with the teachings of this disclosure.

Referring now to the drawings, and with specific reference to FIG. 1, there is shown a schematic of a system 100 in accordance with the present disclosure and generally referred to by reference numeral 100. The system 100 may comprise a display 104, a calibration interface 106, and a controller 108.

This disclosure describes an exemplary embodiment of the system 100. While the exemplary embodiment of the system 100 is described relative to a vibratory compactor 201, the teachings of this disclosure may be employed on other types of compactors 200 (for example, non-vibratory compactors) or other types of compaction devices.

Figure 2:
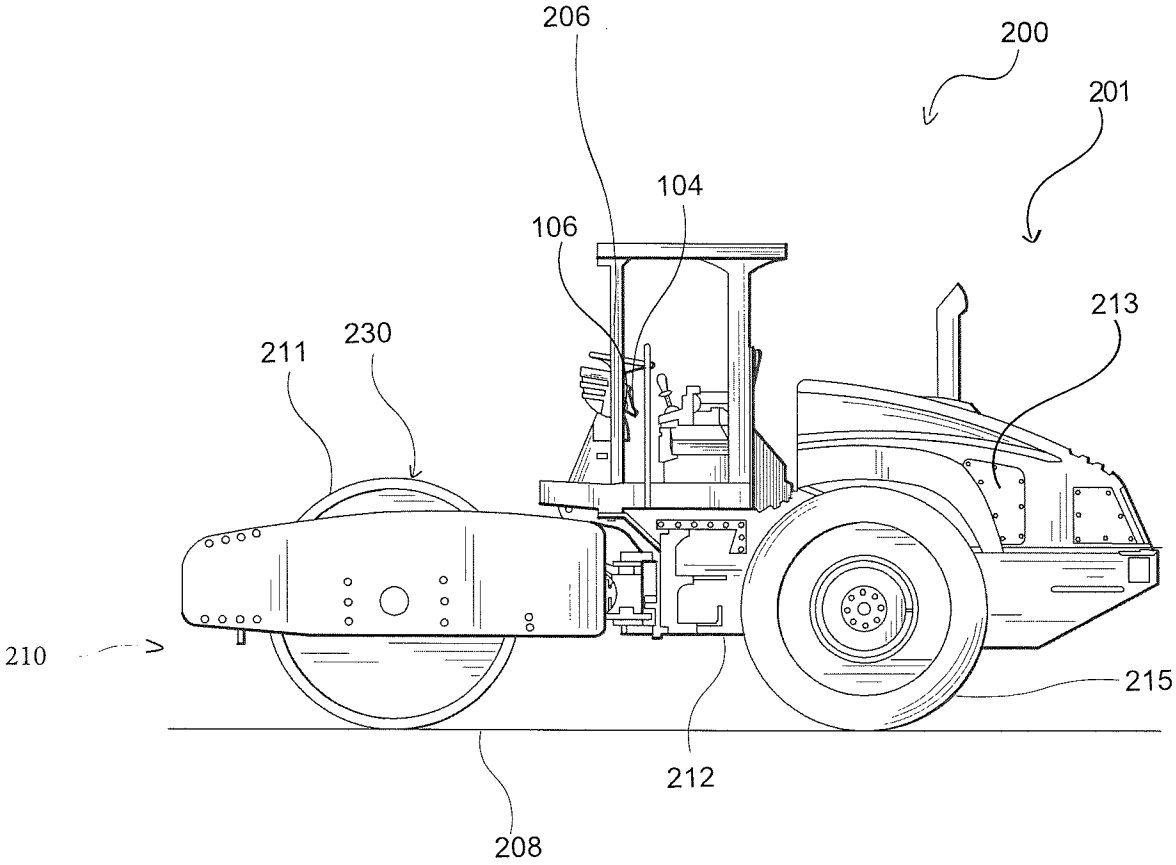
FIG. 2 is perspective view of an embodiment of an exemplary compactor in which the system in accordance with the teachings of this disclosure may be used.

FIG. 2 illustrates an exemplary vibratory compactor 201. In the exemplary embodiment, the vibratory compactor 201 may be a self-propelled single drum compactor with a single cylindrical drum or roller 211 for compacting work material 208 at a work site 210. The vibratory compactor 201 includes a frame 212 and a prime mover such as an engine 213. Engine 213 is a part of a drive system 214 (FIG. 4) that propels the vibratory compactor 201 as desired. The drive system 214 may operate to drive roller 211 and/or one or more deflectable tires 215.

Figure 4:
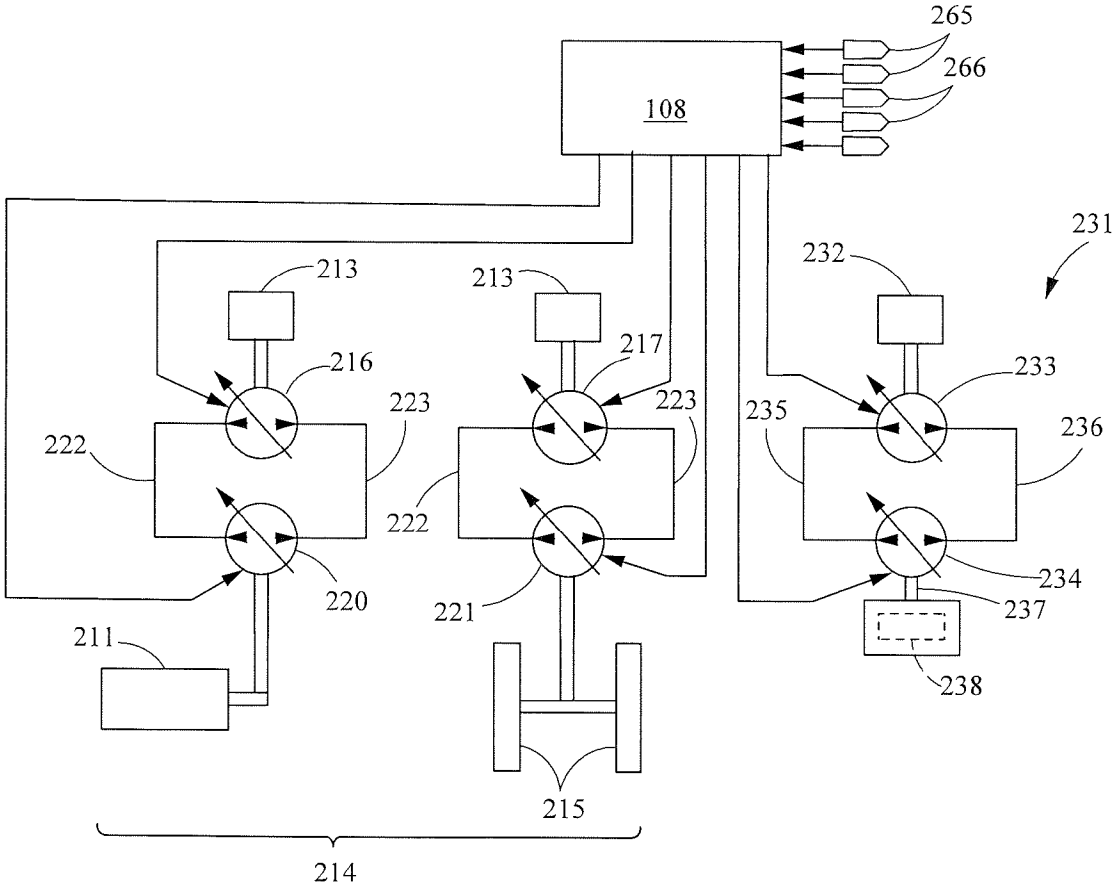
FIG. 4 illustrates a schematic view of an exemplary drive system, and vibration system for the compactor of FIG. 2.

In one embodiment depicted in FIG. 4, drive system 214 may be a hydrostatic system in which engine 213 is operatively connected to first pump 216 and second pump 217. Each of the first pump 216 and the second pump 217 may be operatively hydraulically connected to power first motor 220 and second motor 221, respectively, via a first hydraulic line 222 and a second hydraulic line 223. First motor 220 may be driven by pressurized hydraulic fluid from first pump 216 to rotate roller 211 and second motor 221 may be driven by pressurized hydraulic fluid from second pump 217 to rotate deflectable tires 215.

Each of first pump 216 and second pump 217 may be a variable displacement pump with the displacement controlled by controller 108. In one embodiment, signals from controller 108 may be used to control or adjust the displacement of the first pump 216 and second pump 217. First pump 216 and second pump 217 may each direct pressurized hydraulic fluid to and from their respective motors in two different directions to operate the motors in forward and reverse directions. First pump 216 and second pump 217 may each include a stroke-adjusting mechanism, for example a swashplate, the position of which is hydro- or electro-mechanically adjusted to vary the output (e.g., a discharge pressure or rate) of the pump. The displacement of each of the first pump 216 and the second pump 217 may be adjusted from a zero displacement position, at which substantially no fluid is discharged from the pump, to a maximum displacement position, at which fluid is discharged from the pump at a maximum rate. The displacement of each of the first pump 216 and the second pump 217 may be adjusted so the flow is either into its first hydraulic line 222 or its second hydraulic line 223 so that the pump may drive its respective motor in either forward and reverse directions, depending on the direction of fluid flow. Each of the first pump 216 and the second pump 217 may be operatively connected to engine 213 of vibratory compactor 201 by, for example, a shaft, a belt, or in any other suitable manner.

Each of first motor 220 and second motor 221 may be driven to rotate by a fluid pressure differential generated by its respective pump and supplied through first hydraulic line 222 and second hydraulic line 223. More specifically, each motor may include first and second chambers (not shown) located on opposite sides of a pumping mechanism such as an impeller, plunger, or series of pistons (not shown). When the first chamber is filled with pressurized fluid from the pump via first hydraulic line 222 and the second chamber is drained of fluid returning to the pump via second hydraulic line 223, the pumping mechanism is urged to move or rotate in a first direction (e.g., in a forward traveling direction). Conversely, when the first chamber is drained of fluid and the second chamber is filled with pressurized fluid, the pumping mechanism is urged to move or rotate in an opposite direction (e.g., in a rearward traveling direction). The flow rate of fluid into and out of the first and second chambers may determine an output velocity of the motor, while a pressure differential across the pumping mechanism may determine an output torque.

Each of first motor 220 and second motor 221 may be a variable displacement motor with the displacement controlled by controller 108. In that configuration, the motor has an infinite number of configurations or displacements. In another embodiment, each of first motor 220 and second motor 221 may be a fixed, multi-speed motor. In that configuration, the motor has a finite number of configurations or displacements (e. g., two) between which the motor may be shifted. The motor may thus operate as a fixed displacement motor with a plurality of distinct displacements.

Vibratory compactor 201 may also include a vibratory or vibration system indicated generally at 230 (FIG. 2) associated with roller 211 to impart a compacting force onto the work material 208. More specifically, in addition to the weight of roller 211 and vibratory compactor 201 being applied to the work material 208 to apply compressive forces, the vibration system 230 within roller 211 may operate to apply additional forces to the work material 208. As used herein, vibration system 230 includes any type of system that imparts vibrations, oscillations, or other repeating forces through roller 211 onto work material 208.

Vibration system 230 may take any appropriate form. In one embodiment depicted in FIG. 4, the vibration system 230 may utilize a hydraulic drive system 231 including a vibration system engine 232, distinct from engine 213, that is operatively connected to vibration system pump 233. The vibration system pump 233 may be operatively connected to power a vibration system motor 234 via a first vibration system hydraulic line 235 and a second vibration system hydraulic line 236. Vibration system motor 234 may drive one or more rotatable vibration system shafts 237 that rotate one or more eccentrically mounted masses 238 within roller 211 to create a vibrating or oscillatory force within the roller 211 that is imparted to the work material 208.

Other manners of configuring the vibration system 230 are contemplated. For example, if desired, vibration system engine 231 may be omitted and vibration system pump 233 may be operatively connected to engine 213. Further, in other embodiments, the masses may be moved by mechanical, electrical, or electro-magnetic systems. In addition, in some embodiments, the masses may be moved linearly rather than eccentrically as part of a rotational system.

The vibratory compactor 201 may travel over the work material 208 in forward drive or reverse drive. In some embodiments, the roller 211 may rotate in a clockwise direction when the vibratory compactor 211 is in forward drive and the roller 211 may rotate in a counter clockwise direction when the vibratory compactor 211 is in reverse drive. In other embodiments, the roller 211 may rotate in a counter clockwise direction when the vibratory compactor 211 is in forward drive and the roller 211 may rotate in a clockwise direction when the vibratory compactor 211 is in reverse drive.

The vibratory compactor 201 may include an operator compartment 206 (FIG. 2). The operator compartment 206 may contain a plurality of control devices, such as joysticks, user interfaces, input devices to control various operations, and the like. In an embodiment, the display 104 of system 100 may be disposed in or proximal to the operator compartment 206. In an embodiment, the calibration interface 106 may be disposed in or proximal to the operator compartment 206.

The vibratory compactor 201 may also include a compaction measurement system 270 (FIG. 1). The compaction measurement system 270 may be any appropriate compaction measurement system known in the art, for measuring the compaction or stiffness of the work material 208 as vibratory compactor 201 moves over the work material 208. As the vibratory compactor 201 moves along the work material 208, power is used to compact the work material 208, to move the vibratory compactor 201, and to overcome friction losses of the vibratory compactor 201, and power is gained or lost depending on whether the vibratory compactor 201 is traveling down or up a grade. In one exemplary embodiment, the compaction measurement system 270 may operate based upon the concept that less power is required to move a machine across a harder or more compacted work material 208 as compared to a softer or less compacted work material 208. By determining the actual drive power used by the vibratory compactor 201 as it moves along the surface of the work material 208 and compacts the work material 208, a relative state of compaction of the work material 208 may be determined.

Compaction measurement systems 270 may include one or more sensors or encoders, accelerometers, tri-axial accelerometers, or the like used to measure or calculate compaction or work material 208 stiffness. Such compaction measurement systems 270 may also include Global Positioning Systems, odometers, wheel rotation sensing sensors, lasers, sonar, radar or the like for position identification of the vibratory compactor 201 on the work material 208 being compacted, and for determining heading, pitch and/or roll of the vibratory compactor 201. Such compaction measurement systems 270 may also include drive speed sensing systems, inclination sensing systems, and power loss sensing systems known in the art. For example, the power loss sensing system may determine the amount of power lost or used during a compaction operation. In one embodiment, a power loss sensor may embody motor hydraulic sensors 265 (FIG. 4) to measure the difference between the hydraulic pressure within the first hydraulic line 222 and second hydraulic line 223 at the input and output of each of the first motor 220 and the second motor 221. The amount of power used to compact the work material 208 may be calculated based upon the change in hydraulic pressure between the input and the output of each of the first motor 220 and the second motor 221.

In another embodiment, the power loss sensor may use pump hydraulic sensors 266 (FIG. 4) to measure the difference between the hydraulic pressure within the first hydraulic line 222 and second hydraulic line 223 at the input and output of each of the first pump 216 and the second pump 217. The amount of power used to compact the work material 208 may be calculated based upon the change in hydraulic pressure between the input and the output of each of the first pump 216 and the second pump 217 together with an estimate of line losses that occur as a result of hydraulic fluid being pumped through or along the first hydraulic line 222 and second hydraulic line 223 between each pump and its respective motor. In some embodiments, the drive system 214 may include a mechanical drive with a torque converter (not shown). In such case, the power loss sensor may include sensors that are used to determine the input speed of the torque converter (or the output speed of engine 213) and the output speed of the torque converter. The amount of power used to compact the work material 208 may be calculated based upon the change in speed between the input and the output of the torque converter.

The system 100 (FIG. 1) may be disposed on the vibratory compactor 201. In some embodiments, some elements of the system 100 may be disposed remotely from the vibratory compactor 201. The vibratory compactor 201 may be disposed on a work site.

The display 104 may be disposed on the vibratory compactor 201 or may be remote from the vibratory compactor 201. The display 104 is operably connected to the controller 108. The display 104 may be configured to display operation parameters, compaction values (including baseline compaction values, subsequent compaction values, and adjusted subsequent compaction values), and the like. The compaction values may be obtained during forward drive over the work material 208, and obtained during reverse drive over the work material 208. The compaction values may be representative of the stiffness, or compaction, of the work material 208. In some embodiments, after activation of the calibration interface 106, the display 104 may display compaction values obtained during forward drive over the work material 208, and may display adjusted subsequent compaction values instead of (or in addition to) the compaction values obtained during reverse drive over the work material 208. The compaction values, including the first and second baseline compaction values discussed below, may be obtained or measured by the compaction measurement system 270 for the vibratory compactor 201.

The calibration interface 106 may be disposed on the vibratory compactor 201 or may be remote from the vibratory compactor 201. The calibration interface 106 is operably connected to the controller 108. The calibration interface 106 may have an active state and an inactive state. The calibration interface 106 may be configured to receive activation input and deactivation input. The activation input may be user input. A user may be an operator, supervisor, or the like. Such activation input may be the result of a button, knob, lever, joystick or the like disposed on the calibration interface 106, or remote from the calibration interface 106, being pushed, turned, moved or otherwise triggered. Receipt of the activation input may transition the calibration interface 106 into the active state. Receipt of deactivation input may transition the calibration interface 106 into an inactive state. Similarly, deactivation input may be the result of a button, knob, lever, joystick or the like disposed on the calibration interface 106, or remote from the calibration interface 106, being pushed, turned, moved or otherwise triggered.

In one embodiment, the calibration interface 106 may also be configured to receive as input first and second baseline compaction values. In some embodiments, the first and second baseline compaction values may be user input. The first baseline compaction value may be a compaction value obtained/measured when the roller 211 rotates in a first direction. The second baseline compaction value may be a compaction value obtained/measured when the roller 211 rotates in a second direction, the second direction different from the first direction. In some embodiments, the first direction may occur in forward drive and the second direction may occur in reverse drive. In other embodiments, the first direction may occur in reverse drive and the second direction may occur in forward drive. In some embodiments, the first direction may be a clockwise rotation of the roller 211 and the second direction may be a counterclockwise rotation of the roller 211. In other embodiments, the first direction may be a counter clockwise rotation of the roller 211 and the second direction may be a clockwise rotation of the roller 211. Typically, such first and second baseline values represent compaction values for substantially the same area of the work material 208.

In an embodiment, the calibration interface 106 may transmit such first and second baseline compaction values to the controller 108 for processing, or, in some embodiments, may transmit data representative of such first and second baseline compaction values to the controller 108 for processing. In some embodiments, the calibration interface 106 may also be configured to receive as input an offset between the first and second baseline compaction values and to transmit such offset value to the controller 108 for processing.

The controller 108 may include a processor 110 and a memory component 112. The processor 110 may be a microprocessor or other processor as known in the art. The controller 108 may be configured to receive, when the roller 211 rotates in a first direction, a first baseline compaction value (or data representative of a first baseline compaction value). The controller 108 may be further be configured to receive, when the roller 211 rotates in a second direction, a second baseline compaction value (or data representative of the second baseline compaction value). The first and second baseline compaction values may be received directly or indirectly from the calibration interface 106. In some embodiments, the first and second baseline compaction values may be received from the compaction measurement system 270. The controller 108 may be configured to receive from the compaction measurement system 270 subsequent compaction values (or data representative of each of the subsequent compaction values). Such subsequent compaction values may be obtained by the compaction measurement system 270 when the vibratory compactor 201 is operating in forward drive or reverse drive. In some embodiments, the processor 110 may execute instructions and generate control signals for processing the first and second baseline compaction values to calculate an offset between the first and second baseline compaction values, and for adjusting by the offset the subsequent compaction values obtained while the roller 211 rotated in the second direction. In other embodiments, the processor 110 may execute instructions and generate control signals for processing a received offset between the first and second baseline compaction values, and for adjusting by the offset the subsequent compaction values obtained while the roller 211 rotated in the second direction. In some embodiments, the controller 108 may cause the adjusted subsequent compaction values to be displayed on the display 104 when the calibration interface 106 is in the active state. In some embodiments, the controller 108 may cause the adjusted subsequent compaction value to be displayed on the display 104 instead of the received subsequent compaction value that was obtained while the roller 211 rotated in the second direction. Such processor 110 instructions that are capable of being executed by a computer may be read into or embodied on a computer readable medium, such as the memory component 112 or provided external to the processor 110. In alternative embodiments, hard wired circuitry may be used in place of, or in combination with, software instructions to implement a control method.

The term "computer readable medium" as used herein refers to any non-transitory medium or combination of media that participates in providing instructions to the processor 110 for execution. Such a medium may comprise all computer readable media except for a transitory, propagating signal. Common forms of computer-readable media include, for example, a floppy disk, a flexible disk, hard disk, magnetic tape, or any other magnetic medium, a CD-ROM, any other optical medium, or any other medium from which a computer processor 110 can read.

The controller 108 is not limited to one processor 110 and memory component 112. The controller 108 may be several processors 110 and memory components 112.

As noted previously, the controller 108 may be operably connected to the display 104, calibration interface 106, and compaction measurement system 270. The first and second baseline compaction values may be received by the controller 108 via the calibration interface 106 or, in some embodiments, the compaction measurement system 270. Other compaction values, or data representing compaction values, such as subsequent compaction values, may be received from the compaction measurement system 270 or may be calculated by the controller 108 based on data received from the compaction measurement system 270.

Also disclosed is a method of calibrating a compactor 200 having a roller 211. In an embodiment, the compactor 200 may be disposed at a work site. The method may comprise receiving, when the roller 211 rotates in a first direction, a first baseline compaction value, and receiving, when the roller 211 rotates in a second direction, a second baseline compaction value. The method may further include calculating an offset between the first and second baseline compaction values, and adjusting, by a controller 108 operably connected to the compactor 200, subsequent compaction values by the offset when the subsequent compaction values are obtained during rotation of the roller 211 in the second direction. The method may further include displaying the adjusted subsequent compaction values resulting from the adjusting. In some embodiments, the calculating of the offset may be by the controller 108.

Also disclosed is a method of calibrating a compactor 200 having forward drive and reverse drive. The compactor 200 may include a roller 211. The method may comprise receiving activation input, receiving data representative of a first baseline compaction value obtained when the compactor 200 was in forward drive, and receiving data representative of a second baseline compaction value obtained when the compactor 200 was in reverse drive. The method may further include calculating an offset between the first and second baseline compaction values, and adjusting, by a controller 108 operably connected to the compactor 200, subsequent compaction values by the offset when the subsequent compaction values are obtained during reverse drive of the compactor 200. The method may further include displaying adjusted subsequent compaction values.

INDUSTRIAL APPLICABILITY

Figure 3:
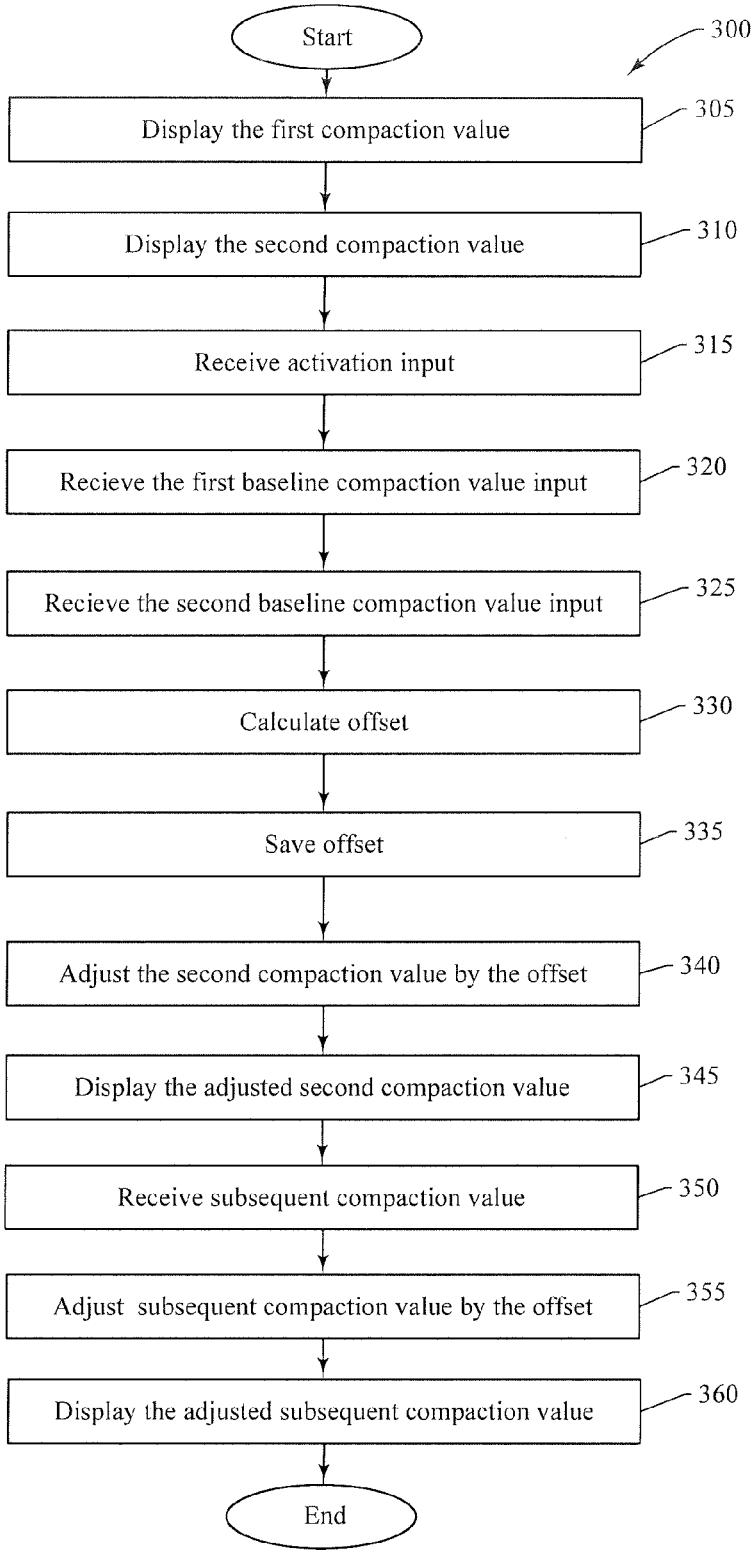
FIG. 3 is flowchart illustrating exemplary blocks of a method of calibrating a compactor having a roller.

Referring now to FIG. 3, an exemplary flowchart is illustrated showing sample blocks which may be followed in a method of method of calibrating a vibratory compactor 201. The vibratory compactor 201 may include a roller 211. The method 300 may be practiced with more or less than the number of blocks shown.

Block 305 of the method 300 includes displaying a first baseline compaction value. The first baseline compaction value may be displayed on a display 104 disposed on the vibratory compactor 201 or remote from the vibratory compactor 201. The first baseline compaction value represents the stiffness or compaction of the work material 208 when the roller 211 is rotating in a first direction. In one embodiment, the vibratory compactor 201 may be in forward drive and the roller 211 may rotate in a clockwise direction. In another embodiment, the roller 211 may be rotating in a counter clockwise direction when rotating in the first direction.

Block 310 of the method 300 includes displaying a second baseline compaction value. The second baseline compaction value may be displayed on a display 104 disposed on the vibratory compactor 201 or remote from the vibratory compactor 201. The second baseline compaction value represents the stiffness or compaction of the work material 208 when the roller 211 is rotating in a second direction opposite to the first direction. In one embodiment, the vibratory compactor 201 may be in reverse drive and the roller 211 may rotate in a counter clockwise direction. In another embodiment, if the roller 211 is rotating in a first direction that is counter clockwise, the roller 211, when rotating in the second direction, may be rotating in clockwise direction.

In block 315, the method 300 may further include receiving activation input. Such activation input may be received by the calibration interface 106 and may cause the calibration interface 106 to transition to an active state. In one embodiment, the calibration interface 106 may transmit a signal to the controller 108 indicative of the receipt of the activation input and the resulting active state of the calibration interface 106.

In block 320, the method 300 may further include receiving the first baseline compaction value input. In an embodiment, the first baseline compaction value input may be received by the calibration interface 106 and then transmitted to the controller 108. In an embodiment, the first baseline compaction value input may be user input into the calibration interface 106. In other embodiments, the first baseline compaction value input may be received by the controller 108 from the compaction measurement system 270.

In block 325, the method 300 may further include receiving the second baseline compaction value input. In an embodiment, the second baseline compaction value input may be received by the calibration interface 106 and then transmitted to the controller 108. In an embodiment, the second baseline compaction value input may be user input into the calibration interface 106. In other embodiments, the second baseline compaction value input may be received by the controller 108 from the compaction measurement system 270.

In block 330, the method 300 may further include calculating, by the controller 108, an offset between the first and second baseline compaction values. For example, in one embodiment, the second baseline compaction value may be subtracted from the first baseline compaction value. The difference would be the value of the offset.

In block 335, the method 300 further includes saving, by the controller 108, the offset in the memory component 112.

In block 340, the method 300 may further include adjusting, by the controller 108, the second baseline compaction value by the offset.

In block 345, the method 300 may further include displaying the adjusted second baseline compaction value resulting from block 340 on the display 104.

In block 350, the method 300 further includes receiving, by the controller 108, at least one subsequent compaction value from the compaction measurement system 270.

In block 355, the method 300 further includes adjusting, by the controller 108, the subsequent compaction value by the offset if the subsequent compaction value is obtained by the compaction measurement system 270 during rotation of the roller 211 in the second direction. For example, in one embodiment, a subsequent compaction value obtained while the roller 211 is rotating in a second direction, for example, the counter clockwise direction, would be adjusted, by the controller 108, by the offset. Subsequent compaction values obtained by the compaction measurement system 270 during rotation of the roller 211 in the first direction would not be adjusted by the offset. In another similar embodiment, a subsequent compaction value obtained while the vibratory compactor 201 is in reverse drive would be adjusted by the controller 108 by the offset. Subsequent compaction values obtained by the compaction measurement system 270 during forward drive would not be adjusted by the offset.

In block 360, the method 300 may further include displaying on the display 104 the adjusted subsequent compaction value resulting from block 355. In one embodiment, the adjusted subsequent compaction value may only be displayed when the calibration interface 106 is in the active state. In one embodiment, the adjusted subsequent compaction value may be displayed instead of (or in addition to) the subsequent compaction value obtained by the compaction measurement system 270 during rotation of the roller 211 in the second direction. Subsequent compaction values that are obtained by the compaction measurement system 270 during rotation of the roller 211 in the first direction may also be displayed, without the adjustment provided by the offset.

The features disclosed herein may be particularly beneficial for use with compactors 200. The ability to display to the operator compaction values that are calibrated for the work site 210 conditions and neutral to the direction of rotation of the roller 211 facilitates better control and use of the machine.

What is claimed is:

1. A system on a compactor, the compactor including a roller, the system comprising:

a display; and a controller configured to:

receive, when the roller rotates in a first direction, a first baseline compaction value;

receive, when the roller rotates in a second direction, a second baseline compaction value;

calculate an offset between the first and second baseline compaction values;

receive a subsequent compaction value obtained while the roller is rotating in the second direction;

adjust the subsequent compaction value by the offset; and display an adjusted subsequent compaction value on the display.

2. The system of claim 1, wherein the adjusted subsequent compaction value is displayed instead of the subsequent compaction value.

3. The system of claim 1, wherein the first direction is clockwise and the second direction is counterclockwise.

4. The system of claim 1, wherein the first direction is counter clockwise and the second direction is clockwise.

5. The system of claim 1, further including a calibration interface having an active state and an inactive state, the calibration interface configured to receive an activation input and the first and second baseline compaction values, wherein receipt of the activation input transitions the calibration interface to the active state, wherein further the first and second baseline compaction values are received by the controller via the calibration interface.

6. The system of claim 5, wherein the adjusted subsequent compaction value is only displayed when the calibration interface is in the active state.

7. The system of claim 1, in which the controller is further configured to receive and display an other subsequent compaction value, the other subsequent compaction value obtained while the roller is rotating in the first direction.

8. A method of calibrating a compactor having a roller, the compactor disposed at a work site, the method comprising:

receiving, when the roller rotates in a first direction, a first baseline compaction value;

receiving, when the roller rotates in a second direction, a second baseline compaction value;

calculating an offset between the first and second baseline compaction values;

adjusting, by a controller operably connected to the compactor, subsequent compaction values by the offset when the subsequent compaction values are obtained during rotation of the roller in the second direction; and displaying adjusted subsequent compaction values resulting from the adjusting.

9. The method of claim 8, wherein the first direction is clockwise and the second direction is counterclockwise.

10. The method of claim 8, wherein the first direction is counter clockwise and the second direction is clockwise.

11. The method of claim 8, further including:

receiving activation input; and transitioning a calibration interface to an active state in response to the activation input, the calibration interface operably connected to the controller, wherein the adjusted subsequent compaction values are displayed instead of the subsequent compaction values when the calibration interface is in the active state and the subsequent compaction values are obtained during rotation of the roller in the second direction.

12. The method of claim 8, wherein the first and second baseline compaction values are received by the controller via a calibration interface operably connected to the controller, and the subsequent compaction values are received by the controller from a compaction measurement system operably connected to the controller.

13. The method of claim 8, wherein the compactor is a vibratory compactor.

14. A system on a compactor, the compactor having forward drive and reverse drive, the compactor including a roller, the system comprising:

a display;

a calibration interface operably connected to a controller and configured to receive activation input; and the controller, the controller configured to:

receive data representative of a first baseline compaction value obtained when the compactor is in forward drive;

receive data representative of a second baseline compaction value obtained when the compactor is in reverse drive;

calculate an offset between the first and second baseline compaction values;

adjust subsequent compaction values by the offset when the subsequent compaction values are obtained during reverse drive of the compactor; and display on the display adjusted subsequent compaction values.

15. The system of claim 14, wherein the first and second baseline compaction values are user input.

16. The system of claim 14, wherein the first and second baseline compaction values are based on data from a compaction measurement system operably connected to the controller.

17. The system of claim 14, wherein the first and second baseline compaction values are received by the controller via the calibration interface, and the subsequent compaction values are received by the controller from a compaction measurement system operably connected to the controller.

18. The system of claim 14, in which the calibration interface is configured to transition to an active state in response to the activation input, wherein the adjusted subsequent compaction values are displayed instead of the subsequent compaction values when the calibration interface is in the active state and the subsequent compaction values are obtained during reverse drive.

19. The system of claim 18, in which the controller is further configured to receive and display, without adjustment, other subsequent compaction values obtained during forward drive.

20. The system of claim 14, wherein the compactor is a vibratory compactor.

* * * * *